US006478196B2

(12) United States Patent
Fuchs

(10) Patent No.: US 6,478,196 B2
(45) Date of Patent: Nov. 12, 2002

(54) MEDIA DISPENSER

(75) Inventor: Karl-Heinz Fuchs, Radolfzell (DE)

(73) Assignee: Ing. Erich Pfeiffer GmbH (DE)

( * ) Notice: Subject to any disclaimer, the term of this patent is extended or adjusted under 35 U.S.C. 154(b) by 0 days.

(21) Appl. No.: 09/215,754

(22) Filed: Dec. 18, 1998

(65) Prior Publication Data

US 2002/0011530 A1 Jan. 31, 2002

(30) Foreign Application Priority Data

Dec. 18, 1997 (DE) ..... 197 56 442

(51) Int. Cl.[7] ..... B65D 88/54

(52) U.S. Cl. ..... 222/321.6; 222/321.8; 222/321.9; 239/463

(58) Field of Search ..... 222/321.8, 321.7, 222/321.6, 321.9; 239/463

(56) References Cited

U.S. PATENT DOCUMENTS 3,897,006 A * 7/1975 Tada ..... 222/321.8
4,271,990 A * 6/1981 Kutik et al. ..... 222/321.8
4,826,052 A * 5/1989 Micallef ..... 222/321.8
5,249,713 A * 10/1993 Reich et al. ..... 222/321.8
5,549,249 A * 8/1996 Foster et al. ..... 239/463

FOREIGN PATENT DOCUMENTS

| | | |
|---|---|---|
| DE | 7901055 | 4/1979 |
| DE | 3736095 | 5/1989 |
| DE | 4008070 | 9/1991 |
| DE | 4030530 | 4/1992 |
| DE | 4035688 | 5/1992 |
| DE | 4332869 | 4/1995 |
| DE | 9610456 | 9/1997 |
| EP | 0487412 | 5/1992 |
| FR | 2528328 | 12/1983 |
| GB | 2042630 | 9/1980 |

* cited by examiner

*Primary Examiner*—Christopher Kim
(74) *Attorney, Agent, or Firm*—Baker Botts LLP

(57) ABSTRACT

Radial actuation of a handle (15) axially retracts the dispensers shaft (6) inclusive an exit head (9) relative to a base body (5) and a reservoir (7). The shaft (6) is prevented from rotating. The medium thus flows from a pressure chamber (26) via an outlet valve (32) through the entire shaft (6) to a medium exit (20) while being swirled. For facilitated handling the base body (5) and the reservoir (7) form a rod-shaped grip with the handle (15) on one side and a finger scallop (72) on the other.

22 Claims, 2 Drawing Sheets

MEDIA DISPENSER

TECHNICAL FIELD AND BACKGROUND OF THE INVENTION

The invention relates to a dispenser for media. They can be liquid, powdery, gaseous and/or pasty. The dispenser may be carried and simultaneously operated single-handed. The discharge unit or deliverer can be a pump, the valve of a pressure vessel, such as an aerosol vessel or the like. The medium may be atomized at the medium exit in an atomized state, or may be discharged as a non-atomized jet, as droplets or as an extruded line.

A small dispenser having an axial actuation stroke of less than 5 mm or 3 mm and a maximum outer diameter of less than 25 mm, 20 mm or 18 mm comprises a handle which could be manually actuated parallel to the axis of the dispenser or transverse thereto. This motion of the handle is to be translated into an axial motion of an actuating shaft. The individual components of such a dispenser are very small. They are sensitive to mechanical loads as well as being difficult to support. An external surface which is irregular over the length of the dispenser and multiply stepped at the outer circumference or in the manual gripping zone may make handling and stowing away difficult.

OBJECTS OF THE INVENTION

An object is to provide a dispenser which obviates the disadvantages of prior art constructions or of the kind as described. Particularly, the intention is for the dispenser to ensure despite miniature dimensions high mechanical stability, safe and precise functioning as well as being easy to use and uncomplicated to handle.

SUMMARY OF THE INVENTION

According to the invention means are provided to reliably guide the actuating shaft radially and/or prevented from rotation over a length which is more than half its diameter. This guidance may be provided in the vicinity of the coupling connection between the handle and the shaft and/or directly adjacent upstream thereof. Guidance is done directly on the inner circumference of the outermost shell wall of the base body. The guide part of the shaft may form an axial stop for the actuated end position or for the position remote from the initial position. This stop abuts against an end face of the housing of the deliverer into which the shaft permanently protrudes.

Over its major length or over more than two-thirds or three-quarters of its length, the dispenser in use has constant outer width. This is reduced only in the vicinity of the exit head. Beyond this width bound only the handle protrudes radially outwards. The dispensers overall length is at least five, seven or eight times more than the outer width. Within the length of constant outer width a medium reservoir is longer than the base body by at least half the bodies length. This constantly wide outer circumference extends over a length of at least 8 cm or 10 cm. Thus this outer circumference forms a favorable gripping face while actuating because all fingers of the user hand can surround and support on it. A removable cover for the exit head directly adjoins the base body and the handle by the cited outer width.

The cited, constantly wide circumferential face of the pin-shaped dispenser is interrupted only in sections which extend over part of the length and of the circumference of the base body. These sections in which the circumferential face is transversely offset relative to the constantly wide portions may be a window opening for engaging the handle, an inclined surface for receiving the handle in the actuated end position or a recessed finger scallop remote from the handle.

The cover cap for the exit head engages the inner circumference of the base body. The cap comprises an inclined face which is tensioned relative to a conical end face of the base body or of the handle. Thus actuation is locked in the initial position. In this position the handle protrudes radially beyond the outer circumference of the base body by maximally a third or half of the constant outer width. In every position the handle is spaced from and located between both ends of the base body so that it cannot cover the reservoir.

The exit head comprises a one-part, oblong head cap. The end wall thereof is traversed by a nozzle duct or the medium exit. A separate nozzle core extends from the inside of this end wall exclusively upstream. This core forms an assembly unit with the actuator. The core is located without contact within the head cap over its major length. An outlet duct traverses the actuator shaft and the nozzle core. In cross-section this duct is non-circular but flat. The cross-sectional length of this duct is at least half or twice as large as its cross-sectional width or at least as large or larger than the outer width of the nozzle core. Thus the duct traverses an outer end wall in the region of the ducts narrow sides. The core body emanates from this wall only upstream. The duct forms passage openings at the outer circumference of the core body and adjoins this end face. Through these openings the medium can exit from the interior of the duct to the outer circumference of the core body.

The passage openings extend up to the inner side of an end wall by the outer side of which the core body is located directly adjacent to the end wall of the head cap or to the inner end of the nozzle duct. An axial duct leads from each opening of the core body to the outside of the end wall of the core body from where a transverse duct is directed to the nozzle duct. Each of the cited duct sections is circumferentially sealingly closed. All duct sections connecting downstream to the duct exits traversing the end wall and these duct exits are bounded in two parts, namely by the actuator shaft and the cap of the exit head. Upstream thereof and up to the pressure space of the discharge unit the duct is located totally within the actuator shaft, which circumferentially entirely bounds the duct in one part. Thus minute dose quantities can be discharged very accurately and thereby atomized.

Reference is made to DE-OS 196 10 456 as regards further features and effects to be incorporated in the present invention.

BRIEF DESCRIPTION OF THE DRAWINGS

Example embodiments of the invention are explained in more detail in the following and illustrated in the drawings in which.

DETAILED DESCRIPTION

Figure 1:
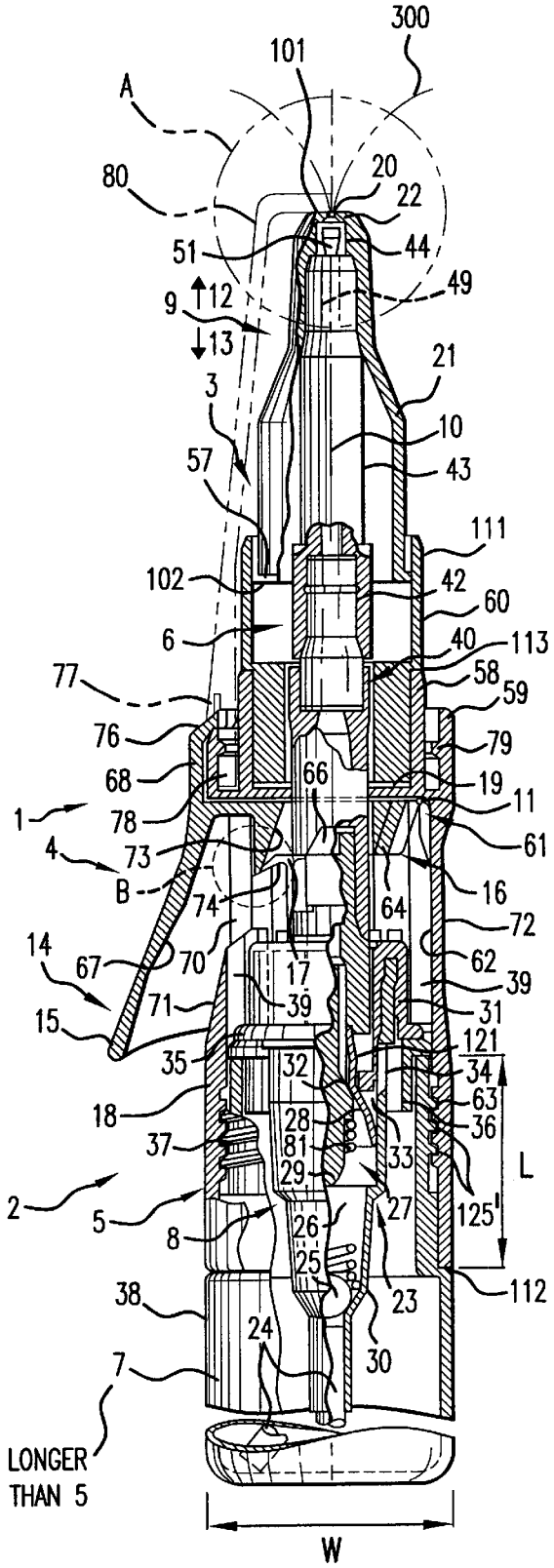
FIG. 1 is an inventive dispenser in side view and partial cross-section.

The dispenser 1 comprises two units 2, 3. They are moved axially relative to each other for discharge actuation and for effecting the discharging pressure of the medium. Thereby a third unit 4 is moved transverse to units 2, 3 along a circular arc. Unit 2 comprises a sleeve-shaped base body 5. The base body of unit 3 is an actuator formed by an actuating shaft or ram 6. A reservoir or flask 7 and the housing of a discharge unit, such as a pump 8 or a thrust piston pump is included in unit 2 which is dimensionally rigid. An exit head 9 located at the downstream base end of body 5 facing away from flask 7 is included in unit 3. When made as a single-use pump without return stroke the reservoir may be formed by the pump or unit casing and totally emptied by a stroke oriented in but a sole direction. All parts of units 2, 3 are located in a common central axis 10, relative to which unit 4 is arranged partly eccentric. The medium flows through the dispenser 1 substantially parallel to axis 10 in downstream direction 12 to the free end of head 9 or downstream. Head 9 is retracted in the opposite or stroke direction 13 when actuated relative to unit 2 and body 5. Unit 4 forms a handle 15 shown in the rest position in FIGS. 1 and 2. For actuation, the handle 15 is pivoted about a pivot axis 11 and caused to approach body 5 at an acute angle to the rear in actuating direction 14. Axis 11 is located within body 5 at right angles transverse to axis 10 on the side thereof which faces away from handle 15.

Unit 4 comprises a driver 16 freely protruding from the inside of dish-shaped handle 15, inserted radially in body 5 and made in one part with unit 4 and handle 15. A counter cam or member 17 for driver 16 is provided on ram 6. Thus the pivot motion of driver 16 results in motion of unit 3 in direction 13. One-part body 5 comprises a wall or jacket 18. Within jacket 18 body 5 includes an end wall 19 which is spaced from and located between the base ends of jacket 18, namely between the upstream and downstream base ends. Wall 19 is located nearer to the downstream base end 111 than to the upstream base end 112 of body 5 and cross-sectionally projects toward axis 10. Thus body 5 forms a cap in which a part of flask 7, pump 8 and members 16, 17 are located. Driver 16 is located directly adjacent to the inner side of wall 19. The linear member 17 connects upstream to driver 16. Pump 8 and flask 7 connect downstream to member 16, 17. Pump 8 extends by its major casing length into flask 7 defining a central reservoir axis which is parallel to respective coaxial with axis 10.

The free end face of the downstream head 101 end of head 9 is traversed by a medium exit 20, namely a nozzle orifice having a diameter of less than half a millimeter about a nozzle axis. Exit 20 is formed by the outer end of a straight nozzle duct 201 which is widened as a funnel in direction 13. This duct 201 traverses end wall 22 which connects to a shell wall 21 in one part and only in direction 13. Walls 21, 22 commonly provide a head casing. The medium leaves exit 20 as an atomized conical jet 300. Head 9 is tapered in direction 12. Head 9 is suitable for being introduced into a body opening like a humans nostril. Then the slimmer end section which has a diameter of less than 7 mm, protrudes into the nostril and the connecting wider section closes off the nostril. During actuation exit 20 is retracted in the nostril and relative to unit 2. Thus the nostril closure by the wider section of shell 21 is opened and the medium distributed over a major length of the nasal duct.

Pump 8 comprises a two-part unit casing 23. A duct or riser tube 24 extends from the upstream end of casing 23 to the bottom of flask 7. An inlet or ball valve 25 connects downstream to riser tube 24. Valve 25 closes and opens tube 24 with respect to a pressure space or chamber 26 pressure-dependently. Opposite to valve 25 the chamber 26 is bounded by a piston unit 27 or the plunger respective piston 28 thereof. Piston 28 includes a piston sleeve. Unit 27 or ram 6 comprises in addition to the sleeve-shaped piston 28 a shaft part or piston core 29 which entirely traverses piston 28. Casing 23 includes upstream and downstream casing sections to thus consist of a longer casing jacket or shell 30 and a shorter cap-shaped closure or cover 31 which includes an internal jacket and is fixedly connected to the downstream casing section or end of shell 30 by a snap connector. Piston 28 slides on the inner circumferential face of shell 30. On this circumference the movable valve element of valve 25 comes into contact. At its downstream end piston 28 comprises an elastically compressible piston neck 121 with an inner circumferential face. Piston 28 and core 29 commonly provide a self-closing outlet valve 32.

Valve 32 opens at a predetermined pressure in chamber 26 or by piston 28 abutting on an inner shoulder of shell 30 at the end of the actuating stroke. An internal jacket of cover 31, which protrudes into shell 30 in direction 13, forms with piston 28, a valve 33 for venting flask 7. The inner circumferential face of piston 28 forms the movable closing face of valve 32. The outer circumferential face of piston 28 forms the movable closing face of valve 33. In its initial or rest position valve 33 is sealingly closed while opening with the start of the piston stroke. Shell 30 is traversed by three apertures or venting ports 34 which are equally distributed about the circumference and connect to cover 31. Chamber 26 is permanently sealed off relative to ports 34. Ports 34 are located in the same axial section as valves 32, 33. Ram 6 traverses cover 31 so that air is able to flow along its outer circumference from outside of the dispenser 1 up to valve 33. With valve 33 opened air then flows through ports 34 as well as along the outside of shell 30 into flask 7. When an overpressure exists in flask 7 this air is also able to flow out in the counter direction.

On the one-part cover 31 casing 23 comprises an outwardly protruding annular flange 35 at a casing transition between the upstream and downstream casing sections. Pump 8 is supported and tensioned against an end face of a neck 37 of flask 7 with an interposed ring or member 36. Neck 37 adjoins the flask belly 38 via an annular flask shoulder against which the upstream base end of jacket 18 may be tensioned. At this end, body 5 comprises a flask connector including a female thread which mates with the male thread of neck 37 and tensions pump 8. Annular member 36 comprises, between flange 35 and neck 37, an annular flange and a shell which protrudes exclusively in direction 13 from this annular flange. The shell radially spacedly surrounds ports 34 or shell 30. For centering shell 30, the member 36 comprises ribs which protrude beyond its inner circumference and directly connect to both the upstream casing section and the ring.

On its inner circumferential face 62 of the jacket 18 includes at least six, eight or ten axial longitudinal ribs 39 providing a rib structure. Ribs 39 are circumferentially uniformly distributed. Ribs 39 correspondingly center cover 31 downstream of flange 35. The upstream ends of ribs 39 are axially tensioned against flange 35. End wall 19 projects radially inwardly over ribs 39. Over its full length the outer diameter of belly 38 is the same as the outer diameter of jacket 18. Belly 38 may consist of a transparent material or comprise a window to permanently enable visual control of the medium level from outside. As evident from FIG. 2 the largest width of unit 4 and of handle 15 is maximally as large as the diameter of jacket 18. The widest portion of handle 15 extends over an angle of more than 100° and less than 180° about axis 10, particularly an angle of 125°. Flask 7 may be removed without destruction from body 5 and replenished with medium.

Figure 4:
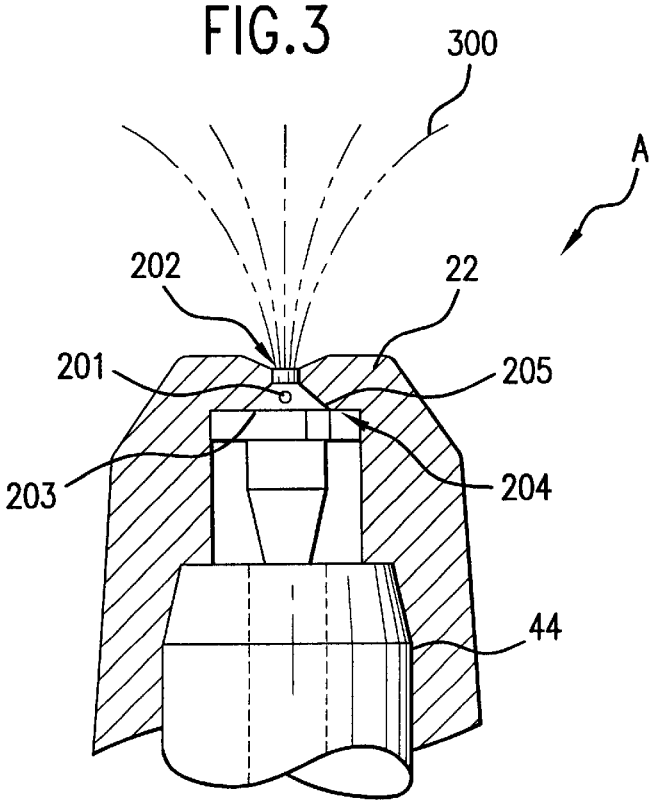
FIG. 4 is an exploded view of a particular portion of an exit head of the dispenser shown in FIG. 1.

Ram 6 is assembled of a plurality of five shaft parts 29, 40 to 43 which chain longitudinally and are interconnected by axial plug connections. These shaft parts or shaft sections may also be commonly made in one part. For example, shaft parts 41 to 43 plus a shaft section 44 and/or shaft parts 40, 42, 43 are in one part. Shaft part or piston core 29 forms the upstream shaft end of ram 6. To the stem of core 29, which protrudes downstream over piston 28, a shaft part 41 connects, which has the same length as core 29 and in the interior of which the core shaft is plugged in. The reduced downstream stem section of part 41 is plugged into the interior of longer shaft part 40. The downstream end of part 40 overlaps the outside of the shortest shaft part 42. Part 42 engages the interior of the next, longest shaft part 43. Thus the mutually facing ends of both shaft part 40, 43 are directly juxtaposed. When in one part the outer width of ram 6 is continuously reduced in direction 12 and not increased. FIG. 4 shows an enlarged view of a particular portion (i.e., portion A as labeled in FIG. 1) of the exit head 9. The downstream end 203 of part 43 forms section 44 which is a core body or nozzle core for a nozzle cap including walls 21, 22. The end or core face of section 44 contacts a shoulder 204 provided by the inside of end wall 22, possibly axially tensioned. This shoulder envelopes the upstream end 205 of the nozzle duct 201, which is end covered by section 44. Part 43 with section 44 forms the downstream shaft end.

Figure 3:
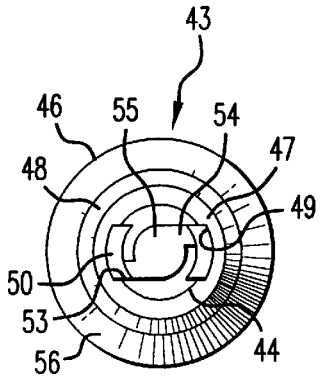
FIG. 3 is an enlarged axial view of the nozzle core body.

The length of section 44 is at the most as large as its diameter which may conically taper by a few degrees in direction 12 or 13. In direction 13 the section 44 connects to a widened shaft section 45. In direction 13 a further widened section 46 connects to section 45. An again widened socket (not shown in FIG. 3) connects to section 46 and receives part 42. The transition between sections 44, 45 is formed by an end face or flat annular core shoulder 47 to which section 45 connects via a section or cone 48 constricted at an acute angle in direction 12. Shoulder 47 projects radially outwardly at the outer circumference of section 44. All cited part sections of part 43 are commonly in one part. Part 43 is traversed by a core or outlet duct 49 which in FIG. 3 is rectangular and flat. The narrow sides of duct 49 are concavely curved about axis 10. The cross-sectional length of duct 49 is at least twice as large as its cross-sectional width or half thereof. Furthermore, the cross-sectional length is at least as large as the outer diameter of section 44. Thus duct 49 emerges at the shoulder 47 only in the vicinity of its narrow sides. In shoulder 47 the duct 49 forms graduated annular ports 50. Ports 50 are curved about axis 10 and oppose each other on both sides of axis 10. Duct 49 also emerges over the same or smaller width at the outer circumference of section 44 with ports 51 which face away from each other. Thus in each case two ports 50, 51 are interconnected at an angle. Duct 49 and ports 51 extend up to an inside of an end wall 52 of section 44. This inside is remote from shoulder 47. The thickness of wall 52 is smaller than the outer diameter of section 44 or half thereof. The outer diameter of section 44 is smaller than 4 mm or 3 mm.

As viewed in FIG. 1 the port 51 may be constricted in width at an acute angle in direction 13. If in production of part 43 the duct 49 is injection molded with a mold core or mandrel the shape of port 51 is achieved alone from the conicity of section 44. The mold core simultaneously forms ports 50, 51 and the inside of wall 52. Wall 52 is connected to section 45, 48 only via two mutually opposing legs separated by ports 51. These legs bulge radially outwards when axially tensioned and can thereby be sealingly pressed against the inner circumference of wall 21. Each of section 45, cone 48, and a section transition 56 is circumferentially and over its entire length in sealing and full contact with the inner circumference of wall 21. Section 46 is at least twice as long as each of section 45, cone 48 and section 56. Section 46 is entirely without contact inside of wall 21. Core 29 and parts 41, 40, 42, 43 are connected to each other resistant to tensile stress, for example, by bonding, welding or snap connectors. Except for core 29 all of these shaft parts are internally traversed by continuations of duct 49 or by central longitudinal bores.

To the downstream end of port 51 and to the outer circumference of section 44 a shallow depression or longitudinal respective axial groove 53 of same width connects. Groove 53 in the outer circumference of section 44 is sealingly covered at its open side by the inner circumference of wall 21. Thus groove 53 and part 40 commonly form a shallow subduct having the same cross-sections as port 50. This shallow duct is traversed by port 51 at its associated flat side and at its upstream end 202. Port 51 extends up to wall 52. The named flat side is traversed by a transverse duct or port 54 downstream of port 51. Port 54 is formed by a groove in the outside of wall 52 which subdivides two grooves 53 providing subducts. The open groove side of this groove is sealingly covered by the inside of wall 22. Port 54 has significantly smaller flow cross-sections than ports 50, 51 and groove 53. Port 54 issues into a widened chamber 55 towards axis 10. Chamber 55 is formed by a circular depression in the outside of wall 52. Chamber 55 has the same diameter as the inner end of the nozzle duct 201. This end is widened and directly connects to chamber 55 which is coaxial with the nozzle duct 201. Ports 54 issue tangentially into chamber 55 in opposing directions and laterally offset from each other. Thus medium flow is caused to swirl and to rotatingly pass the nozzle duct 201.

At an upstream head end, the wall 21 and the head 9 comprise one or more cams 57 or annular beads which protrude beyond its outer circumference. Cam 57 centers and sealingly guides head 9 at an inner circumference of unit 2. Body 5 comprises two intermeshed or nested jackets respective shell walls 58, 59 at its downstream end. Walls 58, 59 are mutually radially spaced and protrude from wall 19 in direction 12. Inner wall 58 protrudes further than outer wall 59. The outer circumference of wall 59 forms a smooth continuation of the constant outer circumference of wall 18. A sleeve-shaped member 60 is inserted in wall 18. A sleeve-shaped member 60 is inserted in wall 58 and includes the downstream base end. Member 60 may also be in one part with body 5. Member 60 axially abuts on wall 58 in direction 13. Member 60 protrudes beyond wall 58 in direction 12 by a sleeve section which is open around axis 10. Cam 57 sealingly slides on the inner circumference of this sleeve section. Thus member 60 telescopically displaceably engages cam 57. The shaft parts 40, 43 may be supported against radial motions within wall 58 or on the inner circumference of member 60. Member 60 is secured to wall 58 by a press fit. Wall 21 is permanently spaced from unit 4 or handle 15 in direction 12.

Figure 2:
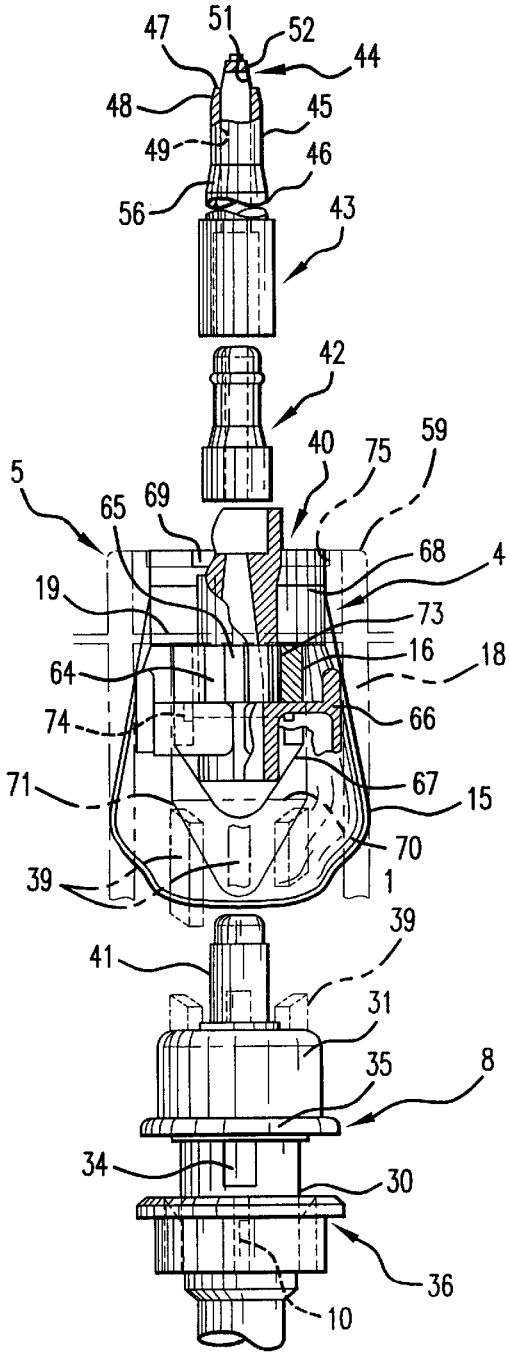
FIG. 2 is an exploded side view of the dispenser from the right in FIG. 1.

Axis 11 is defined by a location or bearing 61 or a knife-edge suspension. The knife edge is formed by an acutely angled corner zone of driver 16. The rectangularly flanked bearing reception or cup is formed by the inside of wall 19 and the length edge of a rib connecting to wall 19. The spacing between axes 10, 11 is slightly less than the radius of the curved inner circumferential face 62 of shell 18 from which ribs 39 emanate. The rib height of the bearing cup is smaller than the height of ribs 39. The ribs of the cup are significantly shorter than ribs 39 and directly connect to both sides of one of ribs 39. Ribs 39 permanently engage inside a guide groove 65 of driver 16. For this purpose driver 16 comprises a projection 64 at its end which is remote from handle 15. The width of projection 64 is reduced relative to driver 16 (FIG. 2). Projection 64 includes groove 65. The widened section of driver 16 comprises a passage for ram 6 or part 40. This passage is located between projection 64 and handle 15. Ram 6 and part 40 are inserted into body 5 and unit 4 in direction 12, like units 7, 8 are.

Sleeve-shaped or first shaft part 40 is in one part with counter members 17. Members 17 protrude beyond the outer circumference of part 40 at two remote sides and form a crossbeam. In view of FIG. 1 members 17 do not protrude beyond the outer circumference of part 40. Members 17 are located nearer to the upstream end than to the downstream end of part 40. At its ends the crossbeam comprises shaft members or slide cams 66 which protrude in direction 12 and which are narrower than the crossbeam. Each cam 66 and thus ram 6 is guided and prevented from rotation by being displaceably received in a slide groove located between two juxtaposed ribs 39. Each cam 66 of ram 6 externally spacedly and laterally overlaps driver 16. Slide cams 66 and the slide groove provide slide members separate from the second shaft part 41 to 44.

Member 17 forms a straight edge or slide face between cam 66 and the opposite outer circumference of part 40. The web-shaped driver face or drive cam 74 of driver 16 permanently supports against this edge with pressure and between axis 10 and handle 15 within jacket 18. Motion of handle 15 in direction 14 thus results immediately in motion of unit 3 in direction 13. Ram 6, head 9 and unit 27 are included in unit 3. Unit 4 is in one part. In the rest position part 40 extends from cover 31 through driver 16 up into wall 58. Thus part 40 protrudes beyond unit 4 in direction 12. Counter faces of members 17 are formed by two edges of the crossbeam. These edges are rounded and mutually aligned. The counter faces of members 17 are located radially within cam 66 and on both sides of part 40. Within driver 16 the ram 6 defines inner and outer circumferential sections remote from pivot axis 11. Drive cam 74 is located radially outside these sections.

Handle 15 is curved about axis 10 to form a tray. The width of handle 15 increases in direction 13 over its major length and then decreases again. Thus side wings or tray legs are formed between the handles ends. The wings are less thick than 1 mm. While laying the wings against the outer circumference 63 of jacket 18 these wings are resiliently spread. Thus the width of handle 15 increases. The wing thickness increases towards the middle of the width of handle 15. Thus the handle 15 is dimensionally stiff in its median zone including the driver 16 emanating therefrom. This median zone includes a reinforcement or wall thickening 67 which provides a counter face, adjoins the driver 16 upstream and reinforces both handle 15 and driver 16. Also a projection or jut 68 of unit 4 may be tray-shaped and resiliently widenable. Jut 68 protrudes beyond driver 16 in direction 12. Jut 68 permanently tightly envelopes the outer circumference 63 over an arc angle which is smaller than that of the wings or maximally 100°.

Jut 68 includes on its inside and downstream end a protruding cam 69. Cam 69 is in contact with the end face of wall 59 in the initial position. Wall 59 and cam 69 have the same radial spacing from wall 58. In this zone a cutout or depression 75 is provided in the end face of wall 59 (FIG. 2). The inclined end section of jut 68 including cam 69 engages inside depression 75. In the initial position unit 4 is positionally locked by cam 69 providing a snap connector. This non-positive or frictional locking can only be overcome with a snap effect or audible click by applying a corresponding high actuating force. Jacket 18 is traversed by an aperture or a rectangular window 70 providing a port and extending only up to the inside of wall 19. Driver 16 is inserted into window 70 radially and transverse to axis 10. From the upstream transverse bound of window 70 and at the outer circumference 63 extends a surface 71 which is planar and inclined away from axis 10 in direction 13. The complementary inclined surface of thickening 67 may be brought fully into contact with surface 71 when handle 15 is in the actuated end position.

Handle 15 covers window 70 permanently completely. For this window 70 and driver 16 have the same width but are significantly narrower than handle 15. Window 70 extends about axis 10 over an arc angle of less than 90°. Circumference 63 is provided with an actuating counter face, depression or scallop 72 on its side facing away from handle 15. Scallop 72 extends over an arc angle of more than 1000 and less than 120°. The scallop depth increases more inclined at the depressions downstream end than at the upstream end. The users thumb or index finger finds support in this scallop when handle 15 is actuated, according as whether handle 15 is actuated by the thumb or index finger. The inner circumference 62 is also constant in width in the vicinity of scallop 72. Thus in this zone jacket 18 is significantly less thick than 1 mm. Scallop 72 bilaterally circumferentially directly connects to circumferential sections of circumference 63 of body 5.

Figure 5:
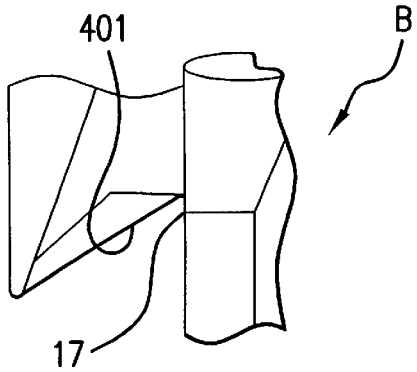
FIG. 5 is an exploded view of a particular portion of a coupling area between a driver and a shaft of the dispenser shown in FIG. 1.

As seen in FIGS. 1 and 2 the driver 16 has the shape of a flat plate. In FIG. 1 this plates thickness increases only between axis 10 and handle 15. Ram 6 and part 40 form an actuator which traverses a transition port of passage 73 of driver 16. Passage 73 is an oblong hole which is circumferentially entirely bounded by a transition bound including bound zones. Because of being oblong this transition bound is circumferentially varingly spaced from pump 8. The minor width of passage 73 is located in the cross-sectional plane of FIG. 2. This width is closely adapted to the corresponding diameter of part 40 with clearance near to zero. The cross-sectional length of passage 73 is located in the cross-sectional plane of FIG. 1 oriented perpendicular to the plane of FIG. 2. In the rest position the hole end or bound zone remote from handle 15 respective most far away from pivot axis 11 is parallel to axis 10 and the end or bound zone near handle 15 is acutely inclined away from axis 10 in direction 13. In the vicinity of this latter end the inclined cams 74 located on both sides of passage 73 slide on members 17 with pressing points 401 (as shown in FIG. 5 which illustrates an enlarged detailed view of the coupling between the driver 16 and the shaft 6 as illustrated in area B of FIG. 1). Jut 68 forms a tray which is curved about axis 10 and includes an end face 76. Face 76 is inclined to be conically flared in direction 13. Face 76 is located on the radial outside of cam 69. When cam 69 engages depression 75 then face 76 forms a smooth continuation of the analogous end or inclined surface of wall 59.

A counter member 77 may be axially tensioned in direction 13 against face 76. Member 77 thereby radially resiliently yields slightly. Member 77 is annularly continuous about axis 10 and therefore tensioned against the end face of wall 59 in the same way. Thus member 77 sealingly closes this end of jacket 18 and unit 4. A sleeve-shaped member 78 protrudes beyond the tensioning end face of member 77 and into the interior of wall 59 in direction 13. Member 78 has a twin-pitch male thread for mating with the female thread 79 of wall 59. A rotation of maximum 180° or 90° is sufficient for screwing member 78 on or off. The inner circumference of member 78 may sealingly contact the outer circumference of wall 58 and member 60. Members 77, 78 may be in one part with a cover 80 or cover cap fully receiving head 9, wall 58 and member 60 while sealingly directly closing exit 20. Cover 80 locks unit 4 against actuation without motion play and tensions unit 4 radially toward axis 10.

Following removal of cover 80 the handle 15 is actuated by finger pressure in direction 14, the cam 69 thereby unsnapping. Thus ram 6 instantly moves in direction 13, piston 28 pressurizes the medium which fills chamber 26 entirely. Thereby valve 25 is tensioned in its closed position. After an axial stroke of between 2 mm and 3 mm valve 32 opens. Then the medium flows between piston 28 and core 29 in direction 12 into the shaft sections. The medium emerges axially as well as radially from ram 6 not before reaching ports 50, 51. Then the medium is caused to rotate in chamber 55 whereafter it is atomized at the bound edge of exit 20. In addition to the force of a return spring 81 an increase of the actuating force is effected over the last stroke section, since the wings of handle 15 must be spread on circumference 63. Spring 81 is located within chamber 26 and is permanently supported with axial pretension on core 29. Valve 32 recloses automatically at the stroke end. Following its release handle 15 and cams 74 are first lifted off from member 17 by the resilient return action of its wings. Simultaneously spring 81 returns unit 3 and also unit 4 to their initial position which is stop limited. Thereby valve 25 opens due to evacuation of chamber 26. Thus while valve 32 is closed medium is sucked from flask 7 into chamber 26 via tube 24.

For assembly pump 8 including member 36 may be inserted in direction 12 into body 5 up to abutment. Thereby the entire ram 6 can be inserted in the same direction through the passages provided in driver 16, wall 19, member 60 and head 9. The dimensions or the dimensional relationship shown are particularly favorable for use of the dispenser 1. All components may consist of plastic material or produced as injection molded items. All properties and effects may be provided precisely as described, or merely roughly so or substantially so, but may also deviate therefrom even more so for corresponding applications. Except for the wings of handle 15, piston 28 and spring 81 each of the components or sections thereof as cited is dimensionally rigid in operation.

What is claimed is:

1. A dispenser for discharging medium, comprising:

a base body including an end wall and defining a central axis;

a reservoir for storing the medium;

a discharge unit for forcing the medium through the end wall in a downstream direction, the discharge unit extending inside the base body;

a handle for actuating the discharge unit and including a driver;

an exit head including a medium exit, an upstream head end and a downstream head end, the end wall being located upstream of the upstream head end; and an actuating shaft connecting the discharge unit with the exit head and engageable with the driver, the actuating shaft being displaceable relative to the base body, wherein the driver is externally overlapped by shaft members of the actuating shaft.

2. The dispenser according to claim 1, wherein the driver includes a transition port circumferentially entirely bounded by a transition bound, the transition bound projecting towards the discharge unit and being circumferentially varyingly spaced from the discharge unit, the driver being located directly adjacent to the end wall.

3. The dispenser according to claim 1, further comprising:

a pivot axis for pivotally actuating the driver, wherein the driver includes a transition port traversed by the actuating shaft, the driver including a driver face for axially pushing the actuating shaft, wherein, in a cross-section perpendicular to the pivot axis, the actuating shaft defines a circumferential section remote from the pivot axis, and the driver face is spaced from the central axis, and wherein the driver face is located radially outside the circumferential section.

4. A dispenser for discharging medium, comprising:

a base body including an end wall and defining a central axis;

a reservoir for storing the medium;

a discharge unit for forcing the medium through the end wall, the discharge unit being mounted on the base body;

a handle for actuating the discharge unit and including a driver;

an exit head including a medium exit; and an actuating shaft connecting the discharge unit with the exit head and engageable with the driver, the actuating shaft being moveable relative to the base body, the actuating shaft being centered and displaceably guided between the end wall and the discharge unit relative to at least one of the base body and the handle, wherein downstream of the end wall the base body includes jacket walls having an outer wall and an inner wall, the inner wall being located inside the outer wall, the actuating shaft traversing the jacket walls.

5. The dispenser according to claim 4, wherein the outer wall defines an outside, the handle being located at the outside.

6. A dispenser for discharging medium, comprising:

a base body including an end wall and defining a central axis;

a reservoir for storing the medium;

a discharge unit for forcing the medium through the end wall, the discharge unit being mounted on the base body;

a handle for actuating the discharge unit and including a driver;

an exit head including a medium exit; and an actuating shaft connecting the discharge unit with the exit head and engageable with the driver, the actuating shaft being moveable relative to the base body, the actuating shaft being centered and displaceably guided between the end wall and the discharge unit relative to at least one of the base body and the handle, wherein downstream of the end wall the base body includes jacket walls having an outer wall and an inner wall, the inner wall being located inside the outer wall, the actuating shaft traversing the jacket walls, and wherein the inner wall axially projects over the outer wall and supports the exit head.

7. A dispenser for discharging medium comprising:

a base body including an end wall and defining a central axis;

a discharge unit for forcing the medium through the base body, the discharge unit being mounted on the base body;

a handle for actuating the discharge unit;

an exit head including a medium exit; and an actuating shaft connecting the discharge unit with the exit head, the actuating shaft being displaceable relative to the base body, wherein the exit head includes a nozzle duct and a nozzle core, the nozzle duct being linear and bounded in one part, the nozzle duct including a downstream end including the medium exit, the nozzle duct including an upstream end enveloped by a shoulder, the nozzle core including a core face directly opposing the shoulder, exclusively upstream of the core face the nozzle core being internally traversed by a core duct which is flat in cross-section, the nozzle core including an outer circumference and a core shoulder projecting radially outwardly at the outer circumference, an axial groove connecting to the outer circumference, the core duct emerging at the outer circumference and at the core shoulder into the axial groove.

8. The dispenser according to claim 7, wherein the axial groove and the nozzle core include a groove bottom, the core face including a transverse groove directly connecting the groove bottom radially inwardly with the upstream end.

9. A dispenser for discharging medium, comprising:

a base body including an end wall and defining a central axis, the end wall cross-sectionally projecting toward the central axis, the base body integrally including a connector and a downstream base end;

a reservoir for storing the medium, the reservoir defining a central reservoir axis substantially parallel to the central axis, the connector directly positively interconnecting the base body and the reservoir;

a discharge unit for forcing the medium through the end wall in a downstream direction, the discharge unit extending inside the base body, the discharge unit being substantially parallel to the central axis;

a handle for actuating the discharge unit and including a driver;

an exit head including a medium exit, an upstream head end and a downstream head end, the end wall being located upstream of the upstream head end; and an actuating shaft connecting the discharge unit with the exit head and engageable with the driver, the actuating shaft being movable relative to the base body substantially parallel to the central axis, the actuating shaft being centered and displaceably guided between the end wall and the discharge unit and the actuating shaft being centered and displaceably guided relative to at least one of the base body and the handle, wherein the downstream base end is open around the central axis and telescopically displaceably engages the upstream head end, the downstream head end being operationally entirely freely exposed and including the medium exit, and wherein the driver includes a transition port circumferentially entirely bounded by a transition bound, the transition bound projecting towards the discharge unit and being circumferentially varyingly spaced from the discharge unit, the driver being located directly adjacent to the end wall.

10. The dispenser according to claim 9, wherein the actuating shaft is rotationally limited with respect to at least one of the handle and the base body, and wherein the exit head is a component which is separate from the actuating shaft, is axially parallel to the central axis, and is directly connected to the actuating shaft.

11. The dispenser according to claim 9, further comprising:

a nozzle duct and a nozzle core, wherein the nozzle duct is linear and bounded in one part, the nozzle duct including an upstream end covered by the nozzle core, the actuating shaft including the nozzle core, the nozzle duct including a downstream end defining the medium exit.

12. The dispenser according to claim 9, further comprising:

a nozzle duct and a head casing traversed by the nozzle duct, wherein the actuating shaft includes a major length section freely exposed without contact inside the head casing, wherein, using the handle, the head casing is operationally displaceable with respect to the base body.

13. The dispenser according to claim 9, further comprising:

a circumferential location remote from the handle, wherein the base body includes circumferential sections and an actuating counter face bilaterally circumferentially directly connecting to the circumferential sections, the actuating counter face being radially displaced towards the central axis with respect to the circumferential sections providing external circumferential faces, the actuating counter face being located at the circumferential location, the central axis being located between the handle and the actuating counter face.

14. The dispenser according to claim 9, further comprising:

a length extension, over which the reservoir engages inside the base body, wherein the base body includes an external circumferential face freely exposed and defining a width extension, the width extension being substantially constant over the length extension, the base body being shorter than the reservoir and including remote ends, the handle being permanently located between the remote ends, the connector being in one part with the base body and the end wall.

15. The dispenser according to claim 9, wherein a bearing defining a pivot axis is provided for pivotally displacing the driver, the bearing being a knife edge suspension bearing including a knife edge and a bearing reception, the bearing reception being angularly flanked and pivotally supporting the knife edge.

16. A dispenser for discharging medium, comprising:

a base body including an end wall and defining a central axis, the end wall cross-sectionally projecting toward the central axis, the base body integrally including a connector and a downstream base end;

a reservoir for storing the medium, the reservoir defining a central reservoir axis substantially parallel to the central axis, the connector directly positively interconnecting the base body and the reservoir;

a discharge unit for forcing the medium through the end wall in a downstream direction, the discharge unit extending inside the base body, the discharge unit being substantially parallel to the central axis;

a handle for actuating the discharge unit and including a driver;

an exit head including a medium exit, an upstream head end and a downstream head end, the end wall being located upstream of the upstream head end; and an actuating shaft connecting the discharge unit with the exit head and engageable with the driver, the actuating shaft being movable relative to the base body substantially parallel to the central axis, the actuating shaft being centered and displaceably guided between the end wall and the discharge unit and the actuating shaft being centered and displaceably guided relative to at least one of the base body and the handle, wherein the downstream base end is open around the central axis and telescopically displaceably engages the upstream head end, the downstream head end being operationally entirely freely exposed and including the medium exit, and wherein the actuating shaft is directly guided on the end wall and spacedly upstream of the end wall, one of the base body and the actuating shaft including a slide groove and another one of the base body and the actuating shaft including a slide cam which displaceably engages the slide groove, and wherein the slide cam is located upstream of the end wall and outside the discharge unit.

17. A dispenser for discharging medium, comprising:

a base body including an end wall and defining a central axis, the end wall cross-sectionally projecting toward the central axis, the base body integrally including a connector and a downstream base end;

a reservoir for storing the medium, the reservoir defining a central reservoir axis substantially parallel to the central axis, the connector directly positively interconnecting the base body and the reservoir;

a discharge unit for forcing the medium through the end wall in a downstream direction, the discharge unit extending inside the base body, the discharge unit being substantially parallel to the central axis;

a handle for actuating the discharge unit and including a driver;

an exit head including a medium exit, an upstream head end and a downstream head end, the end wall being located upstream of the upstream head end;

an actuating shaft connecting the discharge unit with the exit head and engageable with the driver, the actuating shaft being movable relative to the base body substantially parallel to the central axis, the actuating shaft being centered and displaceably guided between the end wall and the discharge unit and the actuating shaft being centered and displaceably guided relative to at least one of the base body and the handle; and slide members including a slide cam and a slide groove displaceably receiving the slide cam, wherein the slide members movably guide the actuating shaft, the slide members being components which are separate from the handle and the exit head, the actuating shaft including a first shaft part and a second shaft part separate from the first shaft part, the first shaft part integrally including one of the slide members and axially fixedly connecting to the second shaft part, wherein the downstream base end is open around the central axis and telescopically displaceably engages the upstream head end, the downstream head end being operationally entirely freely exposed and including the medium exit.

18. A dispenser for discharging medium, comprising:

a base body including an end wall and defining a central axis;

a reservoir for storing the medium;

a discharge unit for forcing the medium through the end wall in a downstream direction, the discharge unit extending inside the base body;

a handle for actuating the discharge unit and including a driver;

an exit head including a medium exit, an upstream head end and a downstream head end, the end wall being located upstream of the upstream head end; and an actuating shaft connecting the discharge unit with the exit head and engageable with the driver, the actuating shaft being displaceable relative to the base body, wherein the base body includes an inner circumference including at least one guide groove, the actuating shaft being guided in the at least one guide groove and being axially stop limited.

19. A dispenser for discharging medium comprising:

a base body including an end wall and defining a central axis;

a reservoir for storing the medium;

a discharge unit for forcing the medium through the end wall, the discharge unit being mounted on the base body;

a handle for actuating the discharge unit and including a driver;

an exit head including a medium exit;

an actuating shaft connecting the discharge unit with the exit head and engageable with the driver, the actuating shaft being moveable relative to the base body, the actuating shaft being centered and displaceably guided between the end wall and the discharge unit relative to at least one of:

the base body, and the handle; and a cover cap for releasably receiving the exit head, the base body including intermeshed jackets, wherein, when operationally covering the exit head, the cover cap projects between the intermeshed jackets and radially tensions the handle against being actuated.

20. A dispenser for discharging media, comprising:

a base body defining a central axis, the base body including base ends including an upstream base end and a downstream base end, the base body including a flask connector made in one part with the upstream base end;

a reservoir for storing the medium, the reservoir including a neck and defining a central reservoir axis substantially parallel to the central axis, the flask connector axially positively interconnecting the base body and the neck;

a discharge unit including a unit casing, a pressure chamber, a piston unit and an actuating shaft manually commonly axially displaceable with the piston unit relative to the base body and the unit casing in a stroke direction for pressurizing the medium within the pressure chamber and for forcing the medium from the pressure chamber through the unit casing, the base body, the piston unit and the actuating shaft in a downstream direction, the stroke direction being oriented opposite to the downstream direction and being substantially parallel to the central axis, wherein the unit casing includes a flange, an upstream casing section and a downstream casing section rigidly connecting to the upstream casing section, the downstream casing section being radially wider than the upstream casing section, the flange being provided in one part with the downstream casing section and radially outwardly projecting over the upstream casing section, the flask connector pressing the flange against the neck, a casing transition being defined between the upstream and downstream casing sections, the flange being located at the casing transition, wherein, inside the reservoir, the upstream casing section envelopes the pressure chamber and the piston unit, the pressure chamber being volumetrically constrictable by axially commonly displacing the actuating shaft and the piston unit relative to the base body and the unit casing from a rest position in the stroke direction up to an end position over a pump stroke, wherein the actuating shaft includes shaft sections having an upstream shaft end and a downstream shaft end, the upstream shaft end including a piston core, wherein the piston unit includes a piston sleeve spacedly enveloping the piston core and displaceably bounding the pressure chamber;

a handle for manually displacing the actuating shaft and the piston unit in the stroke direction, the handle including a driver pressing directly against a counter member for displacing the piston unit in the stroke direction;

an exit head connecting downstream to the actuating shaft and including a medium exit where the medium is environmentally expelled away from the dispenser, the exit head including an upstream head end and a downstream head end;

an outlet duct for guiding the medium from the pressure chamber through the piston sleeve and the actuating shaft into the medium exit, the outlet duct longitudinally traversing the actuating shaft;

at least one valve including an outlet valve for the outlet duct;

an end wall provided downstream of a rib structure and traversed by the actuating shaft, wherein the end wall is in one part with the base body and located downstream of the downstream casing section, the end wall projecting radially inwardly over the rib structure; and rotation prevention means for operationally preventing a rotation of the actuating shaft relative to the base body, the rotation prevention means including a slide groove and a slide cam axially displaceably guided in the slide groove, the slide cam and the slide groove being located within the base body, the slide cam being located upstream of the end wall and axially spacedly directly opposing the end wall, wherein the piston sleeve and the piston core commonly provide the outlet valve, the medium flowing through between the piston sleeve and the piston core into the outlet duct and the downstream head end when the outlet valve is open, the exit head extending downstream beyond the base body, the downstream head end being freely exposed downstream of the base body and including a medium exit downstream of the base body, the flange connecting to the unit casing substantially at the casing transition.

21. A dispenser for discharging media, comprising:

a base body defining a central axis, the base body including base ends including an upstream base end and a downstream base end, the base body including a flask connector made in one part with the upstream base end;

a reservoir for storing the medium, the reservoir including a neck and defining a central reservoir axis substantially parallel to the central axis, the flask connector axially positively interconnecting the base body and the neck;

a discharge unit including a unit casing, a pressure chamber, a piston unit and an actuating shaft manually commonly axially displaceable with the piston unit relative to the base body and the unit casing in a stroke direction for pressurizing the medium within the pressure chamber and for forcing the medium from the pressure chamber through the unit casing, the base body, the piston unit and the actuating shaft in a downstream direction, the stroke direction being oriented opposite to the downstream direction and being substantially parallel to the central axis, wherein the unit casing includes a flange, an upstream casing section and a downstream casing section rigidly connecting to the upstream casing section, the downstream casing section being radially wider than the upstream casing section, the flange being provided in one part with the downstream casing section and radially outwardly projecting over the upstream casing section, the flask connector pressing the flange against the neck, a casing transition being defined between the upstream and downstream casing sections, the flange being located at the casing transition, wherein, inside the reservoir, the upstream casing section envelopes the pressure chamber and the piston unit, the pressure chamber being volumetrically constrictable by axially commonly displacing the actuating shaft and the piston unit relative to the base body and the unit casing from a rest position in the stroke direction up to an end position over a pump stroke, wherein, the actuating shaft includes shaft sections having an upstream shaft end and a downstream shaft end, the upstream shaft end including a piston core, wherein the piston unit includes a piston sleeve spacedly enveloping the piston core and displaceably bounding the pressure chamber;

a handle for manually displacing the actuating shaft and the piston unit in the stroke direction, the handle including a driver pressing directly against a counter member for displacing the piston unit in the stroke direction;

an exit head connecting downstream to the actuating shaft and including a medium exit where the medium is environmentally expelled away from the dispenser, the exit head including an upstream head end and a downstream head end;

an outlet duct for guiding the medium from the pressure chamber through the piston sleeve and the actuating shaft into the medium exit, the outlet duct longitudinally traversing the actuating shaft; and at least one valve including an outlet valve for the outlet duct, wherein the piston sleeve and the piston core commonly provide the outlet valve, the medium flowing through between the piston sleeve and the piston core into the outlet duct and the downstream head end when the outlet valve is open, the exit head extending downstream beyond the base body, the downstream head end being freely exposed downstream of the base body and including the medium exit downstream of the base body, the flange connecting to the unit casing substantially at the casing transition, and wherein one of the base ends of the base body includes first and second intermeshed jackets that have an inner jacket and an outer jacket radially spacedly enveloping the inner jacket, the second intermeshed jacket axially freely protruding over the first intermeshed jacket, the intermeshed jackets including a female thread, the intermeshed jackets protruding away from the handle.

22. A dispenser for discharging media, comprising:

a base body defining a central axis, the base body including base ends including an upstream base end and a downstream base end, the base body including a flask connector made in one part with the upstream base end;

a reservoir for storing the medium, the reservoir including a neck and defining a central reservoir axis substantially parallel to the central axis, the flask connector axially positively interconnecting the base body and the neck;

a discharge unit including a unit casing, a pressure chamber, a piston unit and an actuating shaft manually commonly axially displaceable with the piston unit relative to the base body and the unit casing in a stroke direction for pressurizing the medium within the pressure chamber and for forcing the medium from the pressure chamber through the unit casing, the base body, the piston unit and the actuating shaft in a downstream direction, the stroke direction being oriented opposite to the downstream direction and being substantially parallel to the central axis, wherein the unit casing includes a flange, an upstream casing section and a downstream casing section rigidly connecting to the upstream casing section, the downstream casing section being radially wider than the upstream casing section, the flange being provided in one part with the downstream casing section and radially outwardly projecting over the upstream casing section, the flask connector pressing the flange against the neck, a casing transition being defined between the upstream and downstream casing sections, the flange being located at the casing transition, wherein, inside the reservoir, the upstream casing section envelopes the pressure chamber and the piston unit, the pressure chamber being volumetrically constrictable by axially commonly displacing the actuating shaft and the piston unit relative to the base body and the unit casing from a rest position in the stroke direction up to an end position over a pump stroke, wherein, the actuating shaft includes shaft sections having an upstream shaft end and a downstream shaft end, the upstream shaft end including a piston core, wherein the piston unit includes a piston sleeve spacedly enveloping the piston core and displaceably bounding the pressure chamber;

a handle for manually displacing the actuating shaft and the piston unit in the stroke direction, the handle including a driver pressing directly against a counter member for displacing the piston unit in the stroke direction;

an exit head connecting downstream to the actuating shaft and including a medium exit where the medium is environmentally expelled away from the dispenser, the exit head including an upstream head end and a downstream head end;

an outlet duct for guiding the medium from the pressure chamber through the piston sleeve and the actuating shaft into the medium exit, the outlet duct longitudinally traversing the actuating shaft;

at least one valve including an outlet valve for the outlet duct; and a ring interposed between the flange and the neck, wherein the ring includes an inner circumference, ribs being included and directly connecting to both the upstream casing section and the ring, the ribs protruding beyond the inner circumference, wherein the piston sleeve and the piston core commonly provide the outlet valve, the medium flowing through between the piston sleeve and the piston core into the outlet duct and the downstream head end when the outlet valve is open, the exit head extending downstream beyond the base body, the downstream head end being freely exposed downstream of the base body and including the medium exit downstream of the base body, the flange connecting to the unit casing substantially at the casing transition.

* * * * *